United States Patent [19]

Kanno

[11] Patent Number: 4,905,155

[45] Date of Patent: Feb. 27, 1990

[54] FUEL SUPPLY CONTROL APPARATUS FOR INTERNAL COMBUSTION ENGINE

[75] Inventor: Yoshiaki Kanno, Himeji, Japan

[73] Assignee: Mitsubishi Denki Kabushiki Kaisha, Tokyo, Japan

[21] Appl. No.: 111,256

[22] Filed: Oct. 19, 1987

[30] Foreign Application Priority Data

Oct. 22, 1986 [JP] Japan ..... 61-252320

[51] Int. Cl.[4] ..... F02D 41/30; F02M 51/00

[52] U.S. Cl. ..... 364/431.05; 123/486; 123/494

[58] Field of Search ..... 364/431.04, 431.05; 123/480, 486, 492, 494

[56] References Cited

U.S. PATENT DOCUMENTS

| | | | |
|---|---|---|---|
| 4,662,340 | 5/1987 | Nagano | 123/492 |
| 4,706,632 | 11/1987 | Kasanami et al. | 123/492 |
| 4,712,529 | 12/1987 | Terasaka et al. | 123/492 |
| 4,716,876 | 1/1988 | Shimomura et al. | 123/480 |
| 4,724,816 | 2/1988 | Kanno et al. | 123/490 |
| 4,751,650 | 6/1988 | Wazaki et al. | 364/431.05 |
| 4,760,829 | 8/1988 | Kanno et al | 123/494 X |
| 4,805,577 | 2/1989 | Kanno et al. | 123/492 X |
| 4,819,490 | 4/1989 | Isobe et al. | 123/494 X |

OTHER PUBLICATIONS

Fukui et al.: A New Type Electronically Controlled Fuel Injection System. Society of Automotive Engineers, Inc. Paper #811418. Published 1982 pp. 4229–4235 Copy No. 364–431.05.

*Primary Examiner*—Felix D. Gruber

*Attorney, Agent, or Firm*—Burns, Doane, Swecker & Mathis

[57] ABSTRACT

A fuel supply control apparatus for an internal combustion engine according to the present invention relates to an apparatus, in which the air intake quantity for the internal combustion engine is detected by an air flow sensor and a quantity of a fuel to be supplied to the internal combustion engine is controlled on the basis of an output from said air flow sensor, provided with the air flow sensor and a crank angle sensor for detecting a crank angle of the internal combustion engine and capable of reasonably controlling an air fuel ratio of the internal combustion engine even in the case, where a throttle valve is almost completely opened, by detecting the air intake quantity in a range of a predetermined crank angle interval, determining a resulting value which is proportional to the air intake quantity per one intake stroke of the internal combustion engine, on the basis of the detected value, limiting the resulting value by a predetermined value corrected by parameters of the internal combustion engine, and controlling the quantity of a fuel to be supplied to the internal combustion engine on the basis of the limited resulting value.

5 Claims, 11 Drawing Sheets

(a) OUTPUT FROM THE DIVIDER 31

(b) OUTPUT FROM THE CRANK ANGLE SENSOR 17

(c) $P_D$ (d) $P_R$

FUEL SUPPLY CONTROL APPARATUS FOR INTERNAL COMBUSTION ENGINE

BACKGROUND OF THE INVENTION

1. Field of the Invention

This invention relates to a fuel supply control apparatus for an internal combustion engine capable of detecting an air intake quantity of an internal combustion engine by means of an air flow sensor to control a quantity of fuel to be supplied to the internal combustion engine on the basis of the detected output.

2. Description of the Prior Art

FIG. 1 is a schematic diagram showing a suction or intake air system of an internal combustion engine. Referring now to FIG. 1, a suction air, which has passed through an air cleaner 10, is sucked into an internal combustion engine 1 through an air flow sensor 13 and a throttle valve 12. And, in order to control a fuel quantity in the internal combustion engine 1, an air intake quantity for one intake stroke is determined from an output of the air flow sensor 13 arranged upstream of the throttle valve 12 and the rotation frequency of the engine and a quantity of a fuel to be supplied to the engine is controlled on the basis of the determined air intake quantity per each suction stroke.

However, since blow back or back flow air occurs from the internal combustion engine 1 in the case where the throttle valve 12 is almost completely opened, a quantity of the blow back of back flow air is detected by the air flow sensor 13, whereby the output of the air flow sensor 13 is larger than the quantity of air which is really sucked in the internal combustion engine 1. As a result, in the case where the quantity of a fuel to be supplied is controlled on the basis of an output from the air flow sensor 13, a problem has occurred in that air-fuel mixture is over-rich.

FIG. 2 is a graph showing a relation between a suction pressure (axis of abscissa) and an air intake quantity (axis of ordinate). Referring to FIG. 2, reference mark a designates an output from the air flow sensor 13 and reference mark b designates a quantity of air which is really sucked into the internal combustion engine 1. In addition, FIG. 3 is a graph showing a relation between a time t (axis of abscissa) and a volume of suction air V (axis of ordinate) in the case where the throttle valve 12 is almost completely opened. Referring to FIG. 3, reference mark a designates a quantity of suction air while reference mark b designates a quantity of blow back or back flow air. As understood from FIGS. 2, 3, in the case where the throttle valve 12 is almost completely opened, the blow back or back flow of air from the internal combustion engine 1 is detected by the air flow sensor 13, whereby the air intake quantity for the internal combustion engine 1 can not be accurately detected, and as a result, the above described problem occurs.

FIG. 4 is a graph showing a relation between a rotation frequency Ne (axis of abscissa) of the internal combustion engine 1 and an air intake quantity Qc (axis of ordinate) in the case where the throttle valve 12 is completely opened. The air intake quantity is varied with the number of revolution Ne of the internal combustion engine 1. In addition, since the suction air is warmed in the suction system, the density of the suction air is varied with temperature in the suction system. Furthermore, in the case where water temperature in the internal combustion engine 1 is low, the suction air is warmed to a less extent, whereby the packing efficiency of the suction air is raised. Also in the case where the temperature of the suction air is high, a temperature-rise of the suction air is small, so that the packing efficiency is raised.

Accordingly, in the case where such parameters of the internal combustion engine 1 are disregarded and an output from the air flow sensor 13 is used in the foregoing manner to control fuel, a problem occurs in that the air-fuel mixture is over-enriched.

SUMMARY OF THE INVENTION

The present invention was achieved in order to solve the above described problem and it is a first object of the present invention to provide a fuel supply control apparatus for an internal combustion engine capable of obtaining an accurate air intake quantity and controlling a quantity of a fuel to be supplied to achieve a reasonable or desired air fuel ratio even in the case where a throttle valve is almost completely opened. The foregoing operation is achieved by determining a quantity of a fuel to be supplied, which is proportional to the quantity of a suction air sucked in per one intake stroke of the internal combustion engine 1, on the basis of an output from an air flow sensor and an output from a crank angle detector, and controlling the quantity of a fuel to be supplied to the internal combustion engine on the basis of the resulting value determined by the control operation.

It is a second object of the present invention to provide a fuel supply control apparatus for an internal combustion engine capable of controlling an air fuel ratio of the internal combustion engine by correcting an appointed, or predetermined value required for limiting a value, which is proportional to an air intake quantity for one intake stroke of the internal combustion engine, on the basis of parameters of the internal combustion engine, such as the number of revolutions of the internal combustion engine, the water temperature of the internal combustion engine and the intake air temperature of the internal combustion engine.

The above and further objects and features of the invention will more fully be apparent from the following detailed description with accompanying drawings.

Figure 1:
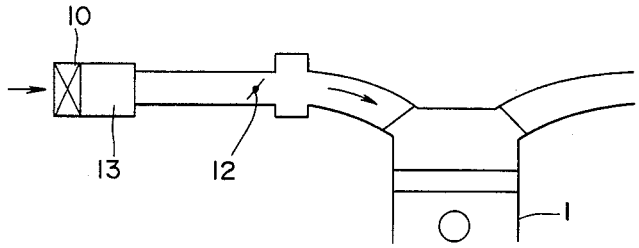
FIG. 1 Prior Art
FIG. 1 is a schematic diagram showing a conventional suction system of an internal combustion engine.
Figure 2:
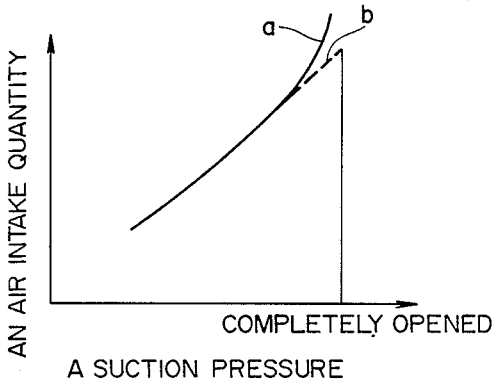
FIG. 2 Prior Art
FIG. 2 is a graph showing a relation between a suction pressure and an air intake quantity in a convention control apparatus for an internal combustion engine.
Figure 3:
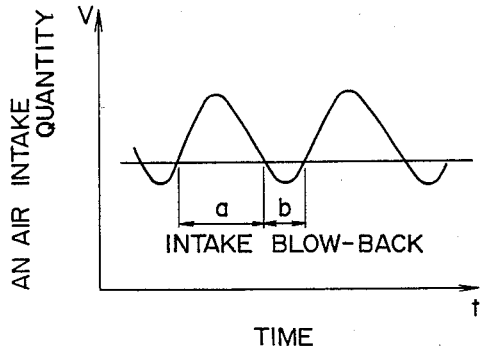
FIG. 3 Prior Art
FIG. 3 is a graph showing a relation between a time and an air intake quantity in a conventional controlling apparatus for the internal combustion engine.
Figure 4:
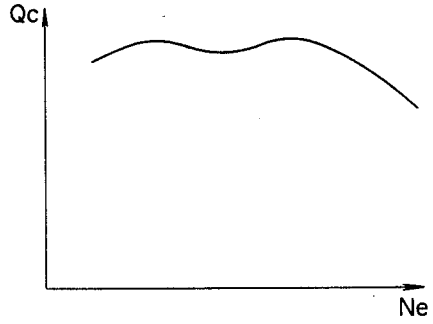
FIG. 4 Prior Art
FIG. 4 is a graph showing a relation between a number of revolution and an air intake quantity for the internal combustion engine in the case where a throttle valve is completely opened.
Figure 5:
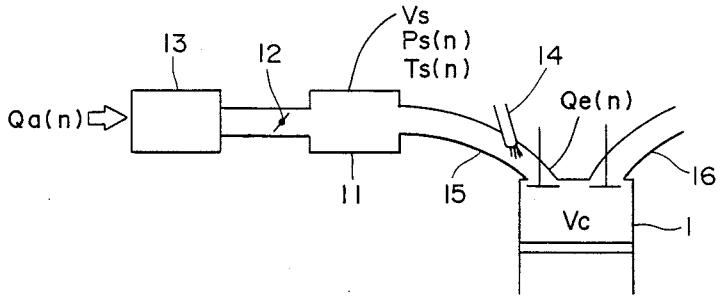
FIG. 5 is a schematic diagram showing a suction system of a fuel supply control apparatus according to the present invention in an internal combustion engine.
Figure 8:
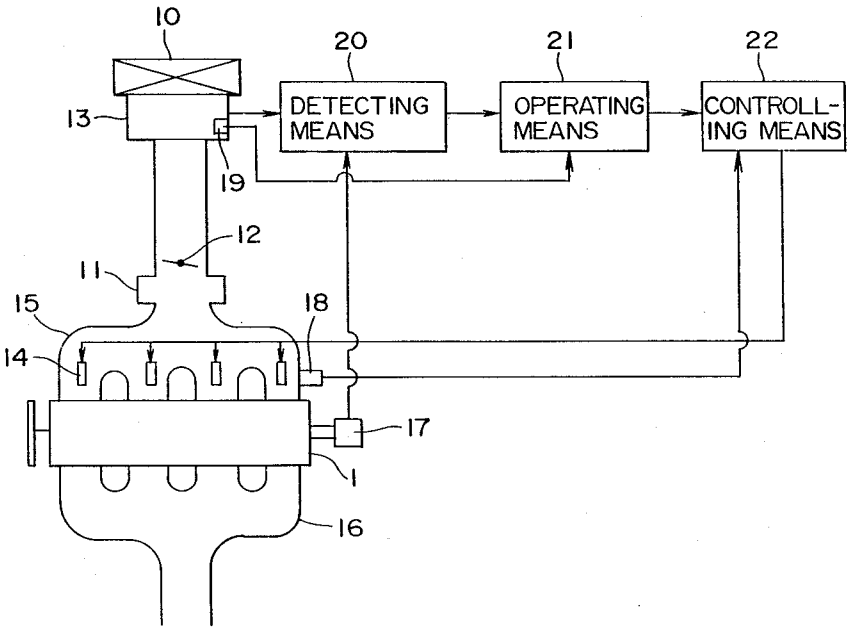
Figure 9:
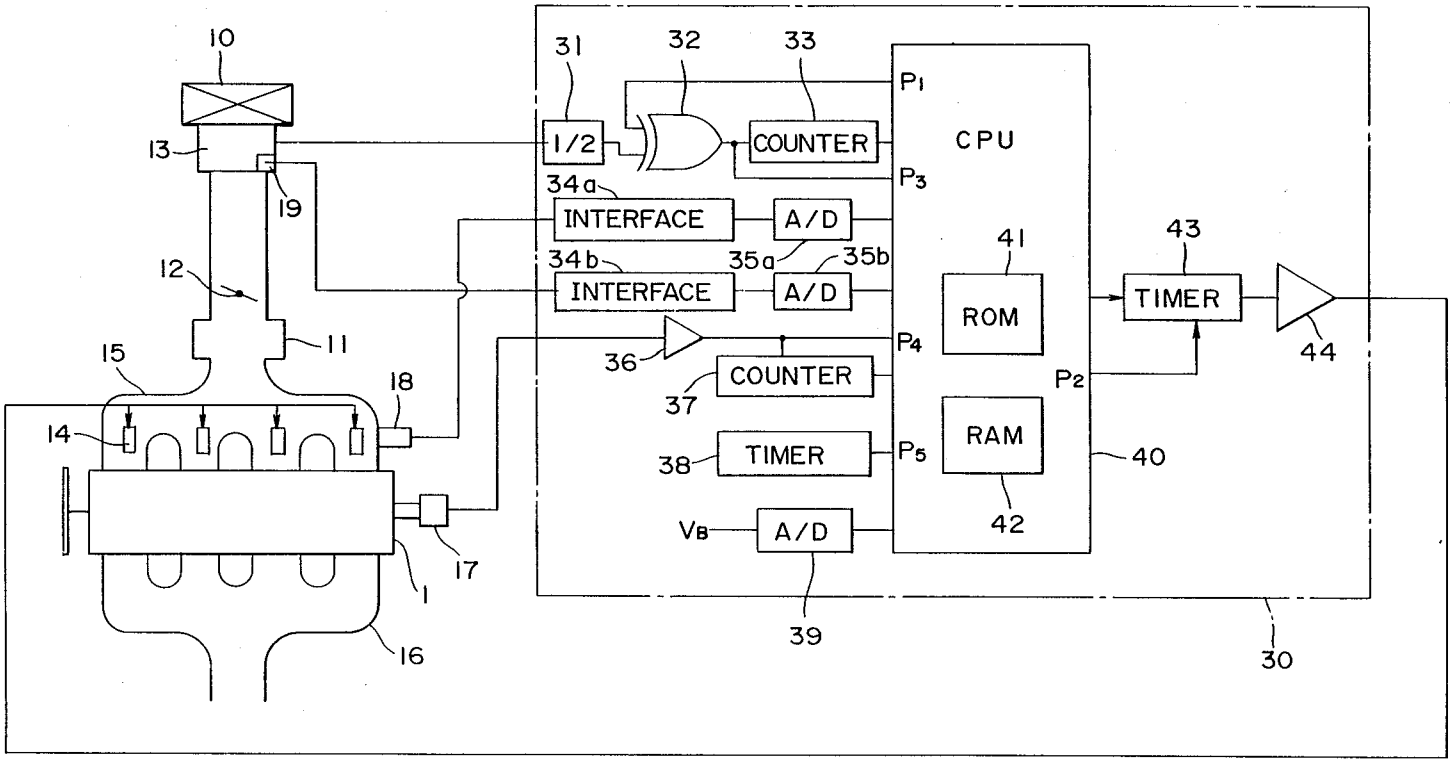
Figure 10:
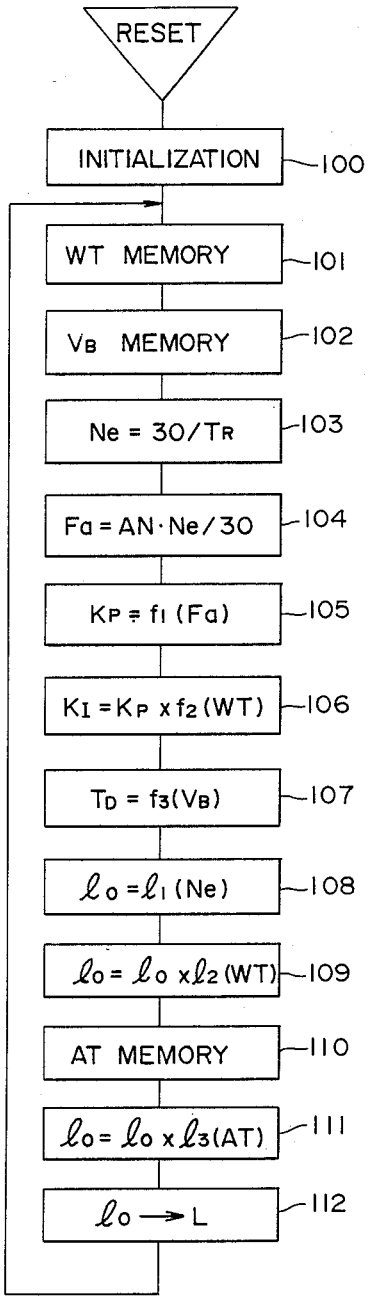
Figure 15:
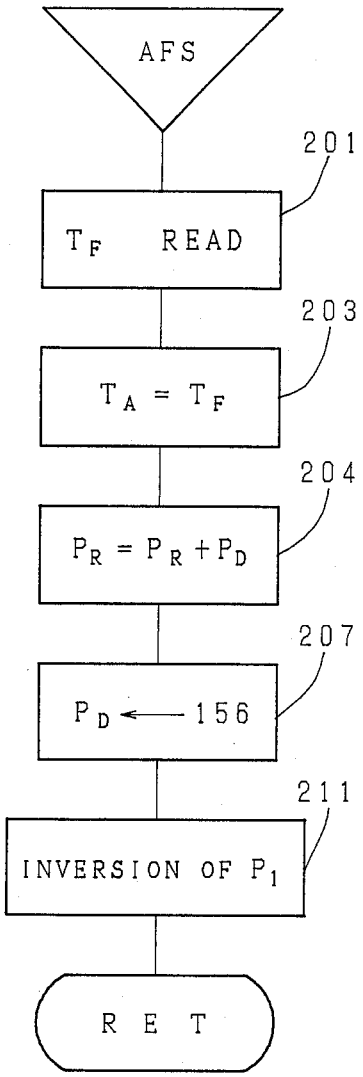
Figure 16:
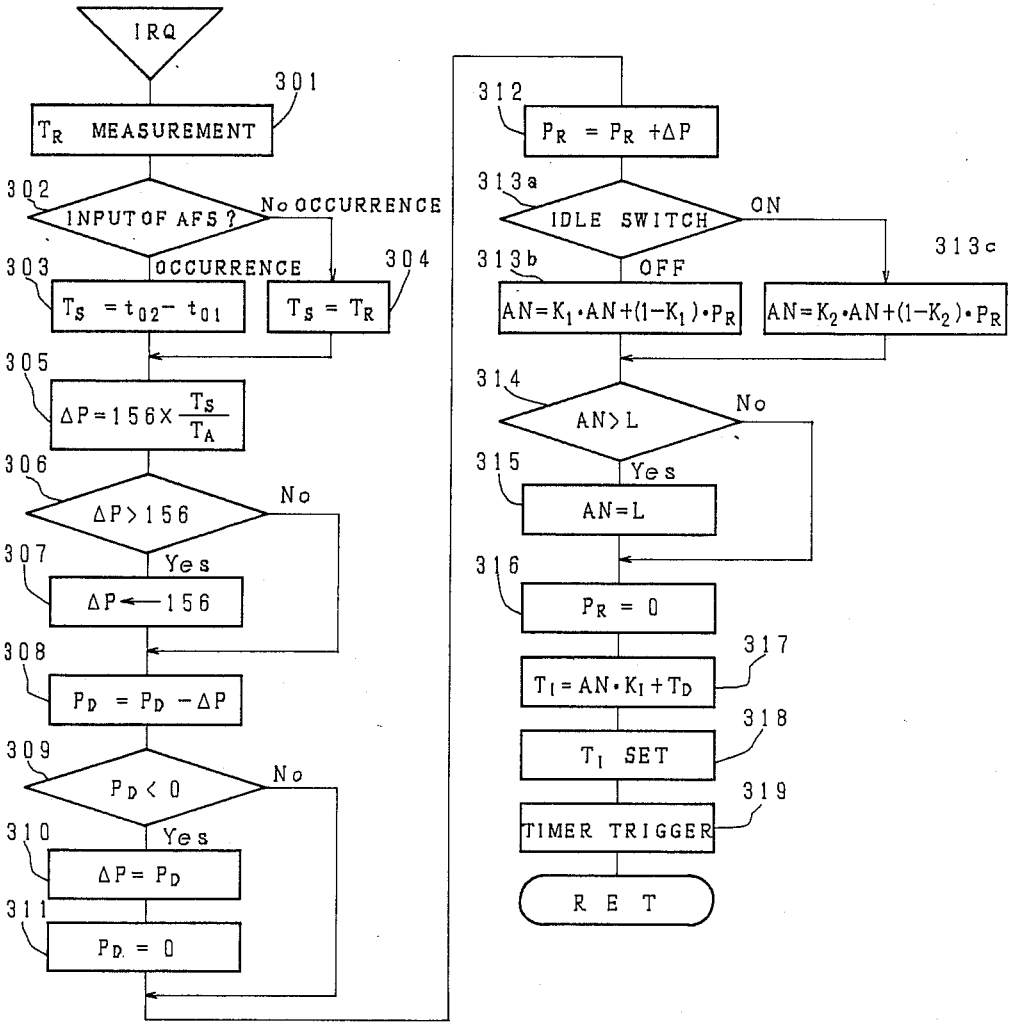
Figure 17:
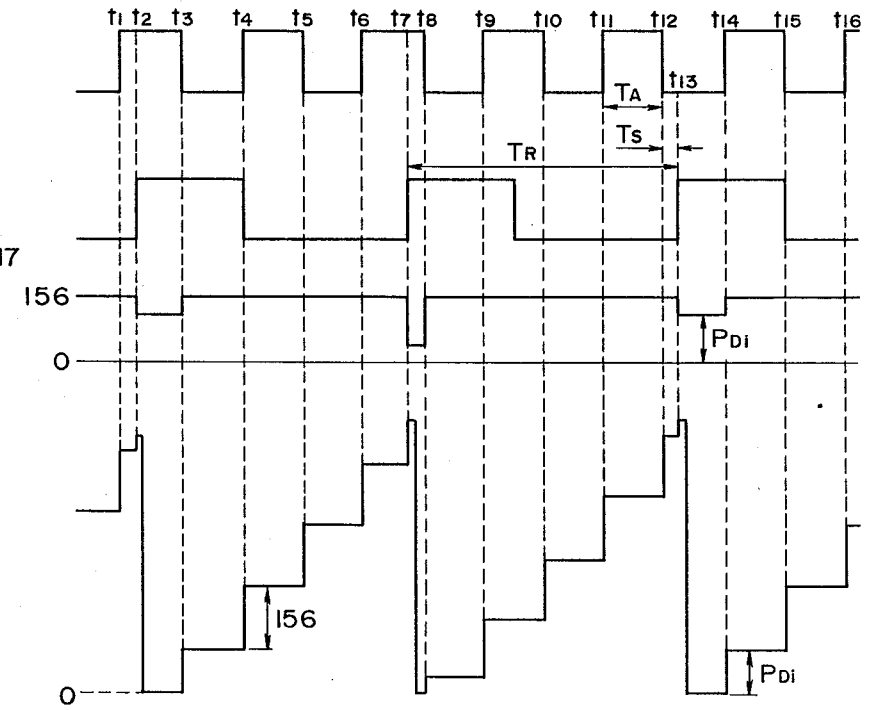

FIGS. *6a* to *6d* are diagrams showing a change of an air intake quantity with a change of a crank angle in the suction system as shown in FIG. 5;

FIGS. *7a* to *7d* are wave shape diagrams showing a change of an air intake quantity for an internal combustion engine under the condition that the throttle valve is opened and closed;

FIGS. 8, 9 are schematic diagrams showing a construction of preferred embodiments of a fuel supply control apparatus according to the present invention in an internal combustion engine;

FIG. 10 is a flow chart showing a procedure of a main program of a CPU in FIG. 9;

FIGS. 11 to 14 are graphs showing characteristics of a correction factor in a fuel supply control apparatus according to the present invention in an internal combustion engine;

FIG. 15 is a flow chart showing a routine of breaking into an output from an air flow sensor in FIG. 9;

FIG. 16 is a flow chart showing a routine of breaking into an output from a crank angle sensor in FIG. 9; and FIG. 17 is a timing chart showing a timing of a flow in the flow charts of FIGS. 15, 16.

DESCRIPTION OF THE PREFERRED EMBODIMENTS

The preferred embodiments of the present invention will be below concretely described.

FIG. 5 shows a suction system of an internal combustion engine. A volume of air sucked in per one stroke of an internal combustion engine 1 is Vc and the air is sucked in the internal combustion engine 1 through an air flow sensor 13, a throttle valve 12, a surge tank 11 and an air inlet pipe 15. Fuel is fed to the internal combustion engine 1 by means of an injector 14. In addition, a volume from the throttle valve 12 to the internal combustion engine 1 is designated by Vs and reference numeral 16 designates an exhaust pipe. Vs indicates the volume of the area between the throttle valve 12 and the internal combustion engine.

In the present preferred embodiment, in order to control an air fuel ratio even in the transition period of the internal combustion engine 1, an operation is carried out to obtain a quantity of air Qe(n) as below described.

Figure 6:
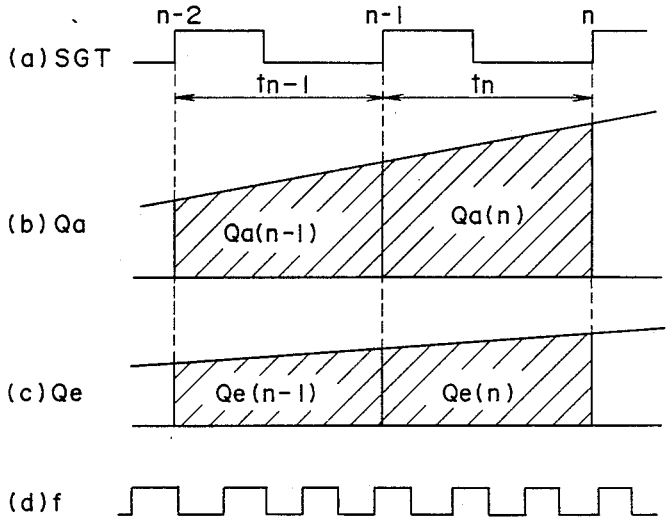

FIG. 6 is a graph showing an air intake quantity at a predetermined crank angle in the internal combustion engine 1. FIG. 6 (*a*) shows an appointed crank angle SGT of the internal combustion engine 1, FIG. 6 (*b*) a quantity of an air Qa passing through the air flow sensor 13, FIG. 6 (*c*) an air intake quantity Qe sucked into a single cylinder of the internal combustion engine 1, and FIG. 6 (*d*) an output pulse of the air flow sensor 13, respectively. In addition, it is provided that a rise period of the (n−2)nd to (n−1)st SGT is $t_n-1$, a rise period of the (n−1)st to n-th SGT being $t_n$, a quantity of air passing through the air flow sensor 13 during the period $t_n-1$ and the period $t_n$ being Qa (n−1) and Qa (n), respectively, and a quantity of air sucked by the internal combustion engine 1 during the period $t_n-1$ and the period $t_n$ being Qe (n−1) and Qe (n), respectively. In addition, it is provided that an average pressure and an average suction air temperature within the surge tank 11 in the case where the period is $t_n-1$ and $t_n$ are Ps(n−1) and Ps and Ts(n−1) and Ts(n), respectively.

Here, the quantity of a suction air Qa(n−1) corresponds to a number of output pulses from the air flow sensor 13 during the period $t_n-1$. In addition, since a changing rate of the suction air temperature is small, provided that Ts(n−1) is nearly equal to Ts(n) and the packing efficiency of the internal combustion engine 1 is fixed, the relations expressed by the following equations (1), (2) hold good.

$$Ps(n-1)Vc=Qe(n-1)RTs(n) \quad (1)$$

$$Ps(n)Vc=Qe(n)RTs(n) \quad (2)$$

Wherein R is constant.

Provided that a quantity of an air collected in the surge tank 11 and the air inlet pipe 15 during the period $t_n$ is ΔQa(n), the following equation (3) holds good:

$$\begin{aligned}\Delta Qa(n) &= Qa(n) - Qe(n) \\ &= \frac{Vs}{RTs}(Ps(n) - Ps(n-1))\end{aligned} \quad (3)$$

Qe(n) is expressed by the following equation (4) from the above described equations (1) to (3).

$$Qe(n) = \frac{Vs}{Vc+Vs}Qe(n-1) + \frac{Vc}{Vc+Vs}Qa(n) \quad (4)$$

Accordingly, the quantity of an air Qe(n) sucked by the internal combustion engine 1 during the period $t_n$ can be calculated by the above described equation (4) on the basis of the quantity of an air Qa(n) passing through the air flow sensor 13. For example, provided that Vc=0.5 liters and Vs=2.5 liters, Qe(n) is expressed by the following equation (5):

$$Qe(n)=0.83\times Qe(nb-1)+0.17\times Qa(n) \quad (5)$$

Figure 7:
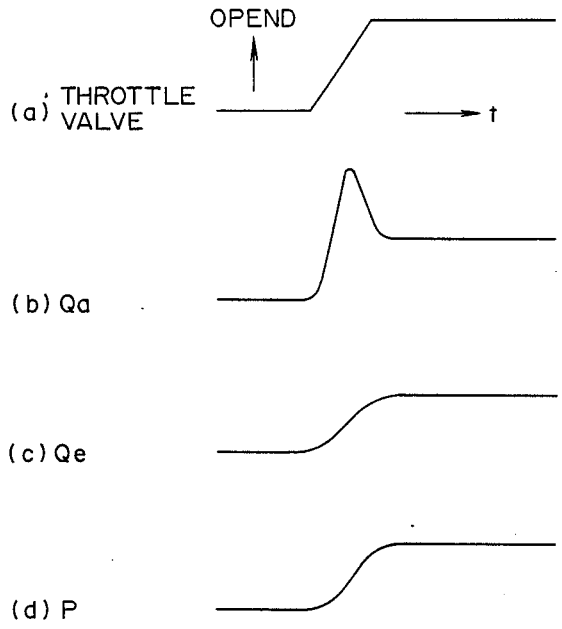

FIG. 7 is a graph showing a time change of physical quantities of suction air in the case where the throttle valve 12 is opened. FIG. 7(*a*) shows an aperture of the throttle valve 12 is opened. FIG. 7(*a*) shows an aperture of the throttle valve 12, FIG. 7(*b*) the quantity of an air Qa passing through the air flow sensor 13, FIG. 7(*c*) the quantity of an air Qe sucked by the internal combustion engine 1 corrected by the above described equation (4), and FIG. 7(*d*) a pressure within the surge tank 11, respectively.

Next, the total construction of the preferred embodiment of the present invention will be described.

FIG. 8 is a schematic diagram showing a construction of a fuel supply control apparatus according to the present invention in an internal combustion engine. Reference numeral 10 designates an air cleaner arranged on an upstream side of the air flow sensor 13. An internal combustion engine 1 is provided with a crank angle sensor 17 for detecting a crank angle thereof and an air inlet pipe 15 is provided with a water temperature sensor 18 for detecting the temperature of a cooling water in the internal combustion engine 1. In addition, the air flow sensor 13 is provided with a suction air temperature sensor 19 for detecting a temperature of the suction air.

The air flow sensor 13 puts out a pulse as shown in FIG. 6(*d*) corresponding to a quantity of an air sucked into the internal combustion engine 1. One output pulse corresponds to a predetermined quantity of air. As an example, if a single pulse per suction corresponds to 0.064 liters of air, three pulses per suction corresponds to 0.192 liters of air. Furthermore, if the output pulse signal is 100 HZ an air quantity of 6.4 liters would be indicated. The sensor 13 is of the type known as a Karman Air Flow Sensor and is known as shown by the attached publication. The crank angle sensor 17 puts out a pulse as shown in FIG. 6(*a*) corresponding to the revolution of the internal combustion engine 1 (for example, the crank angle of 180° from one rise of a pulse to the next rise of a pulse).

A detecting means 20 calculates a number of output pulses of the air flow sensor 13 outputted between two predetermined crank angles of the internal combustion engine 1 on the basis of an output from the air flow sensor 13 and an output from the crank angle sensor 17.

An operating means 21 carries out a calculation as expressed by said equation (5) on the basis of an output from the detecting means 20 and an output from the suction air temperature sensor 19 is used for a correction of thermal expansion; to calculate a number of pulses corresponding to the output from the air flow sensor 13 corresponding to a quantity of an air which is seemed to be sucked in by the internal combustion engine 1. The number of pulses is calculated to permit the control system to correlate the volume of intake air dependent on the number of pulses outputted from the air flow sensor 13.

In addition, a controlling means 22 controls a driving time of an injector 14 depending on the quantity of an air sucked by the internal combustion engine 1 on the basis of an output from the operating means 21 and an output from the water temperature sensor 18, thereby controlling a quantity of a fuel to be supplied to the internal combustion engine 1.

FIG. 9 is a schematic diagram more clearly showing the construction of the preferred embodiment as shown in FIG. 8. A controlling apparatus 30 in FIG. 9 corresponds to an assembly comprising the detecting means 20, the operating means 21 and the controlling means 22 in FIG. 8. The controlling apparatus 30 is an apparatus which receives output signals from the air flow sensor 13, the water temperature sensor 18, the suction air temperature sensor 19 and the crank angle sensor 17 to control four injectors 14 provided at a four cylinder internal combustion engine 1. And, a controlling mechanism in this controlling apparatus 30 is realized by a CPU 40 provided in the controlling apparatus 30 and comprising a ROM 41 and a RAM 42.

A divider 31 is connected to the air flow sensor 13, whereby an output from the divider 31 is put in an exclusive logic sum gate 32. The exclusive logic sum gate 32 is connected to an input $P_1$ of the CPU 40 at the other input terminal thereof and connected to a counter 33 and an input $P_3$ of the CPU 40 at an output terminal thereof.

An interface 34*a* and an A/D converter 35*a* are connected between the water temperature sensor 18 and the CPU 40 in this order from a side of the water temperature sensor 18. In addition, an interface 34*b* and an A/D converter 35*b* are connected between the suction air temperature sensor 19 and the CPU 40 in this order from a side of the suction air temperature sensor 19. A wave shape-adjusting circuit 36 is connected between the crank angle sensor 17 and the CPU 40. The wave shape-adjusting circuit 36 receives an output from the crank angle sensor 17 to give an output to an interrupt input $P_4$ of the CPU 40 and a counter 37.

A timer 38 is connected to an interrupt input $P_5$ of the CPU 40. In addition, and A/D converter 39, which A/D converts a voltage $V_B$ of a battery (not shown) and gives an output to the CPU 40, is connected to the CPU 40.

In addition, a timer 43 and a driver 44 are connected between the CPU 40 and each injector 14 in this order from a side of the CPU 40.

In operation, the output from the air flow sensor 13 is divided by the divider 31 and put in the counter 33 through the exclusive logic sum gate 32 controlled by the CPU 40.

The counter 33 measures a cycle of a descending edge of the output from the exclusive logic sum gate 32. The CPU 40 puts a descent of the gate 32 in an interrupt input $P_3$ and carries out the interrupt treatment at every cycle of an output pulse or equally divided periods of said cycle of the air flow sensor 13 to measure the cycle of the counter 33.

An output from the water temperature sensor 18 is converted into a voltage by means of the interface 34*a* and converted into a digital value at every appointed time by means of the A/D converter 35*a* and subsequently, taken in the CPU 40.

An output from the suction air temperature sensor 19 is converted into a voltage by means of the interface 34*b* and converted into a digital value at every appointed time by means of the A/D converter 35*b* and subsequently, taken in the CPU 40.

An output from the crank angle sensor 17 is put in an interrupt input $P_4$ of the CPU 40 and the counter 37 through the wave shape-adjusting circuit 36.

The CPU 40 carries out the interrupt treatment at every rise of the crank angle sensor 17 and detects a cycle of the rise of the crank angle sensor 17 by an output from an output from the counter 37. The timer 38 gives an interrupt signal to the interrupt input $P_5$ of the CPU 40 at every appointed time.

The A/D converter 39 carries out the A/D conversion of a voltage $V_B$ of a battery (not shown) and the CPU 40 takes this battery voltage therein at every appointed time.

The timer 43 is preset in the CPU 40 and triggered by an output port $P_2$ of the CPU 40 to put out an appointed pulse width to drive the injector 14 through the driver 44.

Next, the operation of the CPU 40 is described with reference to flow charts of FIGS. 10, 15 and 16.

FIG. 10 shows a main program of the CPU 40. Upon putting the reset signal in the CPU 40, the RAM 42, the input-output port and the like are initialized in a step 100 and the output from the water temperature sensor 18 is subjected to the A/D conversion to memorize the converted output as a WT in the RAM 42.

In a step 102 the battery voltage is subjected to the A/D conversion to memorize the converted battery voltage as the battery voltage $V_B$ in the RAM 42.

In a step 103 $30/T_R$ is calculated from the cycle $T_4$ of the crank angle sensor 17, thereby calculating the number of revolutions Ne.

In a step 104 AN·Ne/30 is calculated from a load data AN, which will be mentioned later, and the rotation frequency Ne, thereby calculating an output frequency Fa of the suction air quantity sensor 13.

Figure 11:
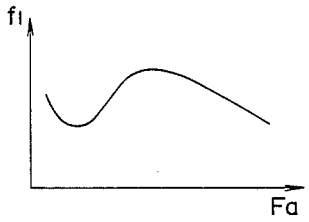

In a step 105 a fundamental driving time conversion factor Kp is calculated from $f_1$ set so as to carry out the linearizing correction of the air flow sensor 13 for the output frequency Fa, as shown in FIG. 11.

In a step 106 the conversion factor Kp is corrected by the water temperature data WT to memorize it as a driving time conversion factor $K_1$ in the RAM 42.

In a step 107 a data table $f_3$, which has been previously memorized in the ROM 41, is mapped from the battery voltage data $V_B$ to calculate a dead time $T_D$ and memorize it in the RAM 42.

Figure 12:
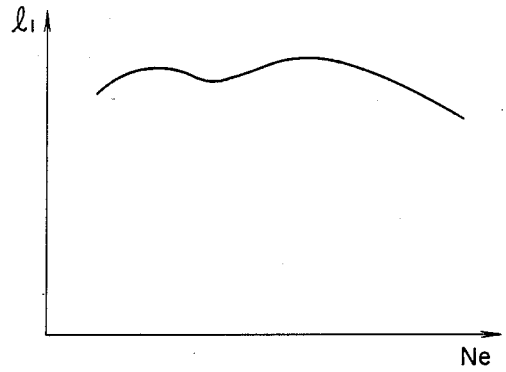

In a step 108 an AN-limiting value $l_0$ is calculated from a characteristic $l_1$, of the load data AN set previously as shown in FIG. 12 in the case where the throttle valve 12 is completely opened relatively to the number of revolutions Ne.

Figure 13:
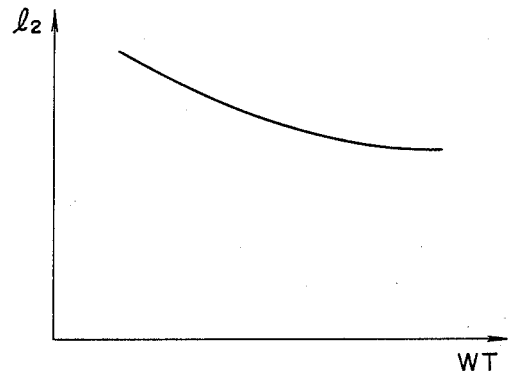

In a step 109 a correction factor is calculated from $l_2$ of FIG. 13 previously set so as to reduce with the rising of water temperature to correct lhd 0.

In a step 110 an output from the suction air temperature sensor 19 is subjected to the A/D conversion to memorize the converted output as AT in the RAM 42.

Figure 14:
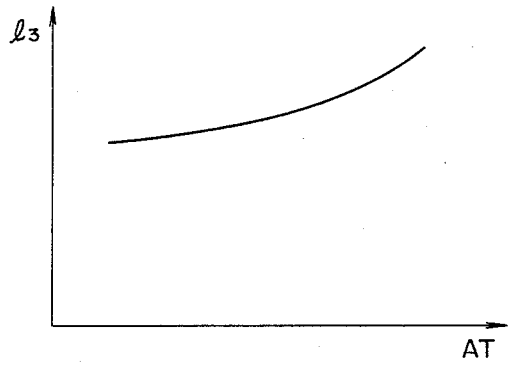

In a step 111 a correction factor is calculated by $l_3$ which has been previously set for the suction air temperature AT so as to increase with the rising of the suction air temperature, as shown in FIG. 14, to correct $l_0$.

In a step 112 $l_0$, which has been calculated in the above described manner, is memorized in the RAM 42 as the AN-limiting value L and the step 101 is repeated.

FIG. 15 shows interrupt treatment for the interrupt input $P_3$, that is to say an output signal from the air flow sensor 13. In a step 201 an output $T_F$ from the counter 33 is detected to clear the counter 33. This $T_F$ is a cycle of the rise of the gate 32.

In a step 203 the cycle $T_F$ is memorized in the RAM 42 as the output pulse cycle $T_A$ and in a step 204 the residual pulse data $P_D$ are added to the integrated pulse data $P_R$.

In a step 207 the residual pulse data $P_D$ is set at 156. The output $P_1$ is altered in a step 211.

FIG. 16 shows an interrupt treatment in the case where a interrupt signal is generated in the interrupt input $P_4$ of the CPU 40 by the output from the crank angle sensor 17.

In a step 301 the cycle between the rises of the crank angle sensor 17 is read from a counter 37 and memorized in the RAM 42 as the cycle $T_R$ to clear the counter 37.

In the case where the output pulse of the air flow sensor 13 exists within the cycle $T_R$ in a step 302, a time difference between a time $t_{01}$ of an immediately preceding output pulse of the air flow sensor 13 and an interrupt time $t_{02}$ of the crank angle sensor 17 ($\Delta t = t_{02} - t_{01}$) is calculated in a step 303 to adopt the resulting difference as the cycle Ts while in the case where the output pulse from the air flow sensor 13 does not exist within the cycle $T_R$, the cycle $T_R$ is adopted as the cycle Ts.

In a step 305, the time difference $\Delta t$ is converted into an output pulse data $\Delta P$ of the air flow sensor 13 by calculating $156 \times Ts/T_A$. That is to say, the pulse data $\Delta P$ is calculated on the assumption that the last output pulse cycle of the air flow sensor 13 is identical with this output pulse cycle of the air flow sensor 13.

In a step 306, if the pulse data $\Delta P$ is smaller than 156, the step is put forward to a step 308 while if the pulse data $\Delta P$ is larger than 156, $\Delta P$ is clipped at 156 in a step 307.

In a step 308, the pulse data $\Delta P$ is subtracted from the residual pulse data $P_D$ to obtain the new residual pulse data $\Delta P$.

In a step 309, if the residual pulse data $P_D$ are positive, the step is put forward to a step 312*a* while in other cases a calculated value of the pulse data $\Delta P$ is larger than the output pulse of the air flow sensor 13, so that the pulse data $\Delta P$ is made equal to $P_D$ in a step 310 and the residual pulse data are made equal to zero in a step 311.

In a step 312, the pulse data $\Delta P$ is added to the integrated pulse data $P_R$.

These data $P_R$ correspond to the number of pulses, which is seemed to be put out by the air flow sensor 13 between these rises of the crank angle sensor 17.

In a step 313, a calculation corresponding to said equation (5) is carried out. That is to say, if an idle switch (not shown) is on in a step 313*a*, it is judged as an idle condition in a step 313*c* and $AN = K_2AN + (1-K_2)P_R$ is calculated by the load data AN and the integrated pulse data $P_R$ calculated until the last rise of the crank angle sensor 17 while if the idle switch is off, $AN = K_1AN + (1-K_1)P_R$ is calculated in a step 313*b* ($K_1 > K_2$). The result is adopted as new load data AN of this time.

In a step 314, if these load data AN are larger than L in the step 112 in FIG. 10, they are clipped at this L in a step 315 so that the load data AN may not be significantly larger than the real value even when the throttle of the internal combustion engine 1 is completely opened. In a step 316, the integrated pulse data $P_R$ are cleared.

In a step 317, the driving time data $T_I = AN \cdot K_1 + T_D$ is calculated from the load data AN, the driving time conversion factor $K_1$ and the dead time $T_D$, in a step 318 the driving time data $T_I$ being set in the timer 43, and in a step 319 the timer 43 being triggered to simultaneously drive four injectors 14 in correspondence to the data $T_I$, thereby completing the interrupt treatment.

FIG. 17 shows a timing in the case corresponding to the treatment as shown in FIGS. 10, 15 and 16. FIG. 17(*a*) shows an output from the divider 31 and FIG. 17(*b*) shows an output from the crank angle sensor 17.

FIG. 17(*c*) shows the residual pulse data $P_D$ which are set at 156 at every rise and descent of the divider 31 (every rise of the output pulse of the air flow sensor 13) and changed to the result of the calculation, for example $P_{Di} = P_D - 156 \times Ts/T_A$, at every rise of the crank angle sensor 17 (this corresponds to the treatments in the steps 305 to 311).

FIG. 17(*d*) shows the change of the integrated pulse data $P_R$, that is to say a manner in which the residual pulse data $P_D$ are integrated at every rise or descent of the output of the divider 31.

In the present preferred embodiment AN is clipped at the limiting value L determined by the number of revolution Ne, the water temperature WT and the suction air temperature AT, so that even though the air flow sensor 13 detects a quantity of an air to a slightly larger extent, the air fuel ratio is not over-enriched, whereby reasonable control can be achieved.

In addition, although the output pulses of the air flow sensor 13 between the rises of the crank angle sensor 17 were counted in the present preferred embodiment, they may be counted between the descents of the crank angle sensor 17. In addition, the output pulses of the air flow sensor 13 for several cycles of the crank angle sensor 17 may be counted.

Furthermore, although the output pulses of the air flow sensor 13 were counted in the present preferred embodiment, a product of the number of output pulses and a constant corresponding to the output frequency of the air flow sensor 13 may be calculated.

Besides, although the crank angle sensor was used for detecting a crank angle in the present preferred embodiment, an ignition signal of an internal combustion engine can be used to obtain the similar effect.

In addition, although the limitation was carried out by the output frequency of the air flow sensor per one suction stroke of the internal combustion engine in the present preferred embodiment, the limitation may be carried out by the air intake quantity calculated from this frequency or the quantity of a fuel to be supplied or the pulse width of the injector.

As above described in detail, with the fuel supply control apparatus for an internal combustion engine according to the present invention, the air intake quantity per one intake stroke of the internal combustion engine is limited by the value determined by the number of revolution of the internal combustion engine and the like so as to obtain the correct air intake quantity even when the throttle valve is completely opened, so that the reasonable control of air fuel ratio can be achieved. Moreover, the limiting value is corrected by the operating parameters of the internal combustion engine, so that the reasonable control of air fuel ratio can be achieved under all operating conditions.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A fuel supply control apparatus for an internal combustion engine, comprising an air flow sensor detecting quantity of intake air for the internal combustion engine, a crank angle sensor for detecting a crank angle of said internal combustion engine, an operating means for determining a value proportional to the quantity of intake air per one intake stroke of said internal combustion engine as provided by an output of said air flow sensor in a range where said crank angle sensor detects the crank angle of the internal combustion engine, said determined value being transmitted as an output to a controlling means for limiting said output of said operating means by a predetermined value L and controlling a quantity of a fuel to be supplied to said internal combustion engine dependent on an output of said operating means.

2. A fuel supply control apparatus for an internal combustion engine as set forth in claim 1, in which said predetermined value L is corrected by operating parameters of the internal combustion engine.

3. A fuel supply control apparatus for an internal combustion engine as set forth in claim 2, in which one of the operating parameters is the number of revolutions of the internal combustion engine.

4. A fuel supply control apparatus for an internal combustion engine as set forth in claim 2, in which one of the operating parameters is water temperature in the internal combustion engine.

5. A fuel supply control apparatus for an internal combustion engine as set forth in claim 2, in which one of the operating parameters is air intake temperature for the internal combustion engine.

* * * * *